US007197770B1

(12) United States Patent
Warren

(10) Patent No.: US 7,197,770 B1
(45) Date of Patent: Apr. 3, 2007

(54) ROLLING KNEEPAD DEVICE

(76) Inventor: Wesley Warren, 15 N. Franklin St., Cortland, NY (US) 13045

( * ) Notice: Subject to any disclaimer, the term of this patent is extended or adjusted under 35 U.S.C. 154(b) by 188 days.

(21) Appl. No.: 10/990,098

(22) Filed: Nov. 15, 2004

Related U.S. Application Data

(63) Continuation-in-part of application No. 10/361,557, filed on Feb. 11, 2003, now abandoned.

(60) Provisional application No. 60/427,562, filed on Nov. 20, 2002.

(51) Int. Cl.
*A41D 13/06* (2006.01)

(52) U.S. Cl. ..... 2/24; 280/32.5

(58) Field of Classification Search ..... 2/23, 2/24, 62, 16, 911; 280/86.751, 29, 32.5, 280/32.6

See application file for complete search history.

(56) References Cited

U.S. PATENT DOCUMENTS

| | | | |
|---|---|---|---|
| 718,875 | A | 1/1903 | Pettersen |
| 1,533,907 | A | 4/1925 | Whipp |
| 1,547,166 | A | 7/1925 | Davidson |
| 2,291,094 | A | 7/1942 | McCarthy |
| 2,448,427 | A | 8/1948 | Gordon |
| 5,380,021 | A | 1/1995 | Doherty |
| 5,427,391 | A | 6/1995 | Cooper |
| 5,870,774 | A | 2/1999 | Legenstein |
| 5,937,440 | A | 8/1999 | Ferriter |
| 6,219,845 | B1 | 4/2001 | Ferriter |

FOREIGN PATENT DOCUMENTS

| | | |
|---|---|---|
| GB | 2215585 | 9/1989 |

*Primary Examiner*—Tejash Patel
(74) *Attorney, Agent, or Firm*—Mark Levy & Associates, PLLC; David L. Banner

(57) ABSTRACT

A rolling kneepad having a weight transfer support assembly with swivel casters to support a user, a kneepad cushion provided above the support assembly to comfortably receive a user's knee, and a shin guard peripherally attached to the support assembly and extending outwardly therefrom. The elongated shin guard has a distal end which abuts the upper surface of a user's shoe or boot. Consequently, when the user moves from a kneeling to a standing position, the weight of the rolling kneepad is supported on the top surface of the user's shoe or boot. Downward slippage of the rolling kneepad along the user's leg is prevented and manual reposition of the rolling kneepad prior to the user resuming a kneeling position is avoided. Straps having hook and loop fasteners at the ends are typically used to affix the rolling kneepad to the body of the user.

18 Claims, 8 Drawing Sheets

ROLLING KNEEPAD DEVICE

RELATED APPLICATIONS

This application is a Continuation-in-Part of my application Ser. No. 10/361,557 filed Feb. 11, 2003, now abandoned, which claims the benefit of U.S. Provisional Patent Application Ser. No. 60/427,562, filed Nov. 20, 2002.

FIELD OF THE INVENTION

The present invention relates to kneepad supports and, more particularly to a rolling kneepad support that provides weight transfer support to the distal portion of a user's leg as well as to an upper region of the user's foot. The kneepad support rolls on casters to provide flexibility of movement to the user thereof.

BACKGROUND OF THE INVENTION

Protective kneepads are often used by workers who must work on their knees as part of their day-to-day work. Such work includes installing floors, working on automobiles, performing masonry work and doing plumbing. The specific type of kneepads used by these workers can have rollers or casters on them to facilitate moving the user around on his or her knees. Such kneepads may be found in the prior art. However; such kneepads, at least those that are designed for physical attachment to the user's body, suffer from a common problem. When the user of these prior art kneepads stands up from the kneeling position, the kneepads are prone to dislocation from their intended position proximate the user's knees. This movement occurs because the weight of the kneepads with their casters, rollers, etc. is sufficient to overcome the restraining force of straps or other attachment devices used to hold them in position. Consequently, gravity pulls the prior art kneepads lower along the leg of the user, making it difficult and sometimes impossible for the user to walk. The kneepads must then be repositioned before the user may again resume a kneeling position on the floor or ground. Attempts have been made to overcome this problem by providing more and/or tighter restraining devices about the shin and calf, but this solution has typically subjected the user to discomfort from the tighter restraints.

DISCUSSION OF THE RELATED ART

Many attempts have been made to provide kneepads. These attempts have failed to provide the features embodied in the kneepads of the present invention. For example, U.S. Pat. No. Des. 330,957 for COMBINES CREEPER AND TOOL CADDY issued to Contrini discloses an ornamental design for a combined creeper and tool caddy.

U.S. Pat. No. 718,875 for KNEE REST issued to Pettersen teaches a knee rest and support. The Pettersen knee rest and support is specifically designed for use by a person when scrubbing or working upon floors, thereby allowing the user to work upon the floor with ease and without danger of soiling their garments by contact with the floor.

U.S. Pat. No. 1,533,907 for KNEE PROTECTOR issued to Whip teaches the use of a knee protector provided with a tension adjusting means and means for permitting passage of air through the kneepads.

U.S. Pat. No. 1,547,166 for KNEE PAD issued to Davidson provides a kneeling pad for workmen and laborers whose occupation necessitates kneeling. The Davidson pad is typically attached to only one knee of the user and is equipped with a pair of rollers to facilitate movement of the user.

U.S. Pat. No. 2,291,094 for ELECTRICAL LIGHTED CREEPER TRANSPORT SERVICE UNIT issued to McCarthy, discloses a service creeper having a border structure for the protection and insulation of multiple segregated artificial lighting elements, to assist the visualizing of objects to be viewed and to prevent the glare of light from interfering with the workman's vision during manually operative control.

U.S. Pat. No. 2,448,427 for KNEE PAD DOLLY issued to Gordon, provides a creeper having padded recesses for placement of a user's knees.

U.S. Pat. No. 5,380,021 for MOBILE KNEE SUPPORT APPARATUS issued to Doherty, provides sheet material slings supported on horseshoe-shaped devices, each mounted on three casters which form a vehicle to support the knees of a user. Provisions are made for the supports to be interconnected by a flexible connector or by a rigid table-like sheet.

U.S. Pat. No. 5,427,391 for PIVOTED KNEE SKATES issued to Cooper, teaches a pivoted knee skate with a leg rest having an upper surface and lower surface, a foot rest having an upper surface and a lower surface, a plurality of wheels, a coupling mechanism rotatably coupling wheels to the lower surface of the leg rest and wheels to the lower surface of the foot rest. A securement mechanism coupled to the leg rest and footrest is provided for securing the upper surface of the leg rest to the lower leg of a user and the upper surface of the footrest to the foot of a user.

U.S. Pat. No. 5,870,774 for ROLLING KNEE PAD issued to Legenstein, teaches roller kneepads having relatively short hard shells, each supported by a plurality of swiveling casters. The inside of the hard shell is lined with a cushioning material to absorb shock when kneeling and to cushion against minor shape disparities between the wearers' knees and the inside of the hard shell. A strap is provided for attaching the shells to the wearer's calves. A plate is attached to the exterior portion of the hard shell to provide mounting locations for a plurality of casters. The casters are capable of swiveling through a 360 degree range.

U. S. Pat. Nos. 5,937,440 and 6,219,845, both for KNEE PROTECTOR and issued to Ferriter, each teach a wheeled support for a kneeling person and includes a pair of knee supports, each having a frame, a pad mounted on the frame and a three-wheel assembly mounted on the bottom of the frame. Also included is a pair of wheeled foot supports, which can be used in conjunction with the wheeled support.

Great Britain patent number 2 215 585 for KNEE PAD granted to Nierhaus, teaches a kneepad having a lower portion, which is substantially cylindrical, for abutment with the upper end of the shinbone of the wearer, and an upper portion, which is in the form of a sector of a sphere, for abutment with the kneecap of the wearer. A retaining strap engages with the lower lateral edge of the lower portion and goes around the leg of the wearer, rather than the popliteal space immediately behind the knee.

Although each of these patents provides for some support of at least the knee of the user, none is believed to comfortably support the knee and lower shin/upper foot while in use. A kneepad that transfers a wearer's weight to a knee, lower shin, and upper foot rather than to a strap or along a shin, would be more comfortable for a user and would be of benefit to those that must use a kneepad or "creeper" type of device.

None of the above inventions and patents, taken either singly or in combination, is seen to describe or suggest the instant invention.

SUMMARY OF THE INVENTION

In accordance with the present invention, there is provided a contiguous rolling kneepad including swivel casters. This rolling weight transfer support device is supported on a platform having multiple swivel casters to provide flexibility of motion to the structure. The structure not only supports the knee of the user but the shin and upper portion of the user's foot as well. The structure is designed to properly distribute the user's weight onto the support so that maximum comfort is provided the user. One or more strap fasteners are provided to secure the user's knees and shins to the rolling kneepad caster device. The inventive contiguous rolling kneepad devices of the invention may be worn on only a single knee and leg or, as is more typically the case, a device is fastened to each knee and leg of the user. The length of the rolling kneepad of the invention is designed so that the distal end of the shin guard rests against an upper surface of the user's shoe or boot. Consequently, when the user rises from a kneeling position to a standing position, the distal end of the shin guard is supported by the upper surface of the user's shoe or boot. Consequently, no downward slipping movement is possible and the rolling kneepad of the invention is in proper position when the user again assumes a kneeling position. Moreover, since no strap is required at the midpoint of the shin guard, blood flow to the extremities of the users legs is not impaired.

Accordingly, it is an object of the invention to provide a rolling kneepad device with a shin guard that is more comfortable to wear than current rolling kneepads with shin guards.

It is another object of the invention to provide a rolling device having a shin guard that precludes any need for straps binding a midpoint of a user's legs which may impair blood flow to the extremities of the user's leg when carrying the device's weight when the user walks.

It is a further object of the invention to provide a rolling device having a shin guard that prevents movement of the rolling device downward along a wearer's leg when the wearer moved from a kneeling to an upright position.

It is yet another object of the invention to provide a rolling device having a shin guard that does not interfere with the walking ability of a wearer of the rolling device.

It is an additional object of the invention to provide a rolling kneepad device that, when the wearer thereof is upright, supports the device's weight by a shin guard that transfers the device's weight to the top of the foot instead of to the leg or ankle through straps.

It is a further object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

A complete understanding of the present invention may be obtained by reference to the accompanying drawings, when considered in conjunction with the subsequent detailed description, in which.

Similar reference characters denote corresponding features consistently throughout the attached drawings.

DETAILED DESCRIPTION OF THE PREFERRED EMBODIMENT

The present invention is a rolling kneepad for use by persons engaged in activities practiced in a kneeling position. The rolling kneepad of the invention provides mobility to those persons. In addition, unlike kneepads of the prior art, the rolling kneepad of the present invention stays in place when the wearer stands. The novel design prevents either downward motion or rotation of the kneepad in while standing or walking thereby allowing the wearer to kneel again without need for repositioning or readjusting the rolling kneepad device.

Figure 3:
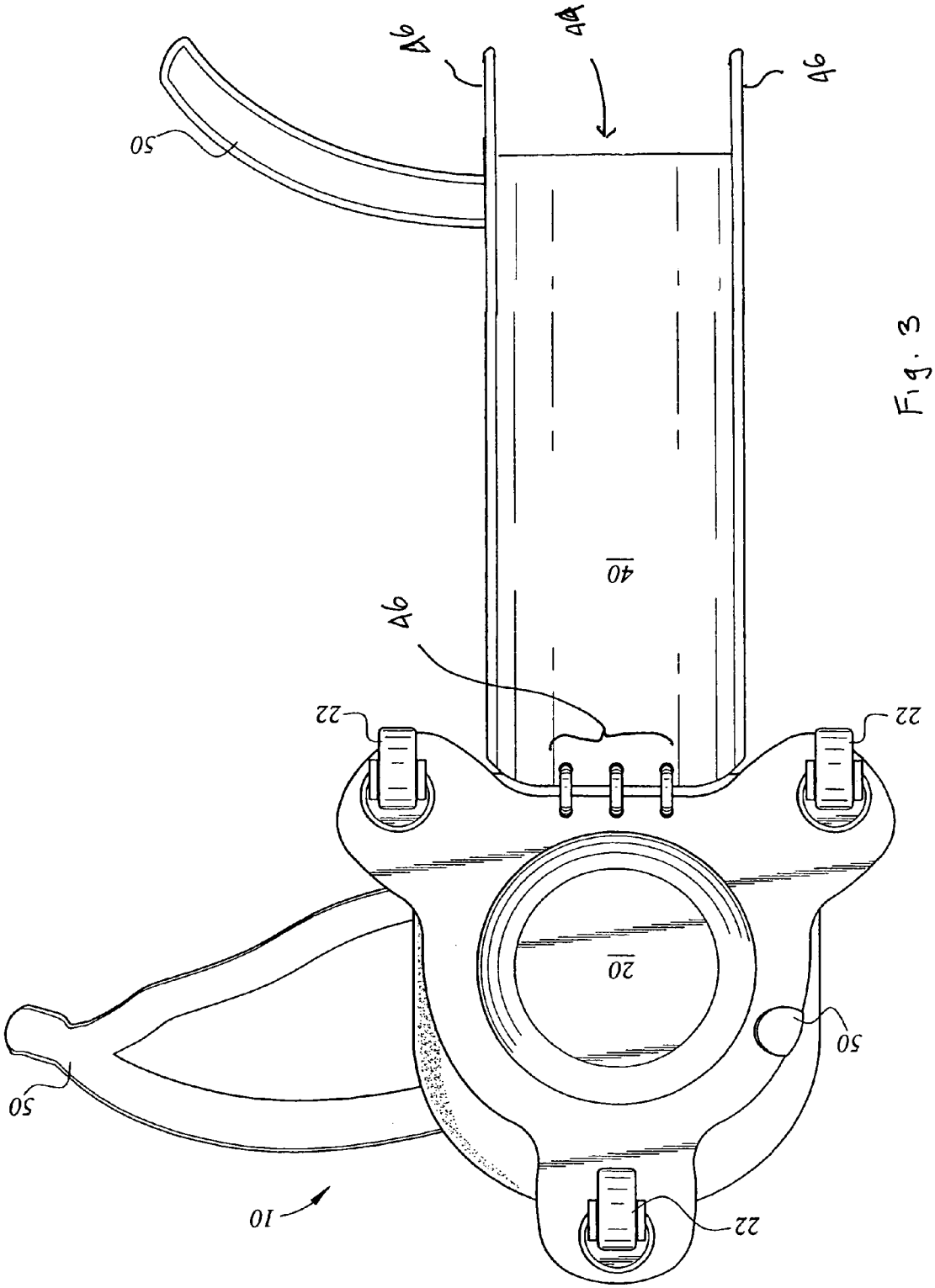
FIG. 3 is a bottom plan view of the rolling kneepad device of FIG. 1.
Figure 7:
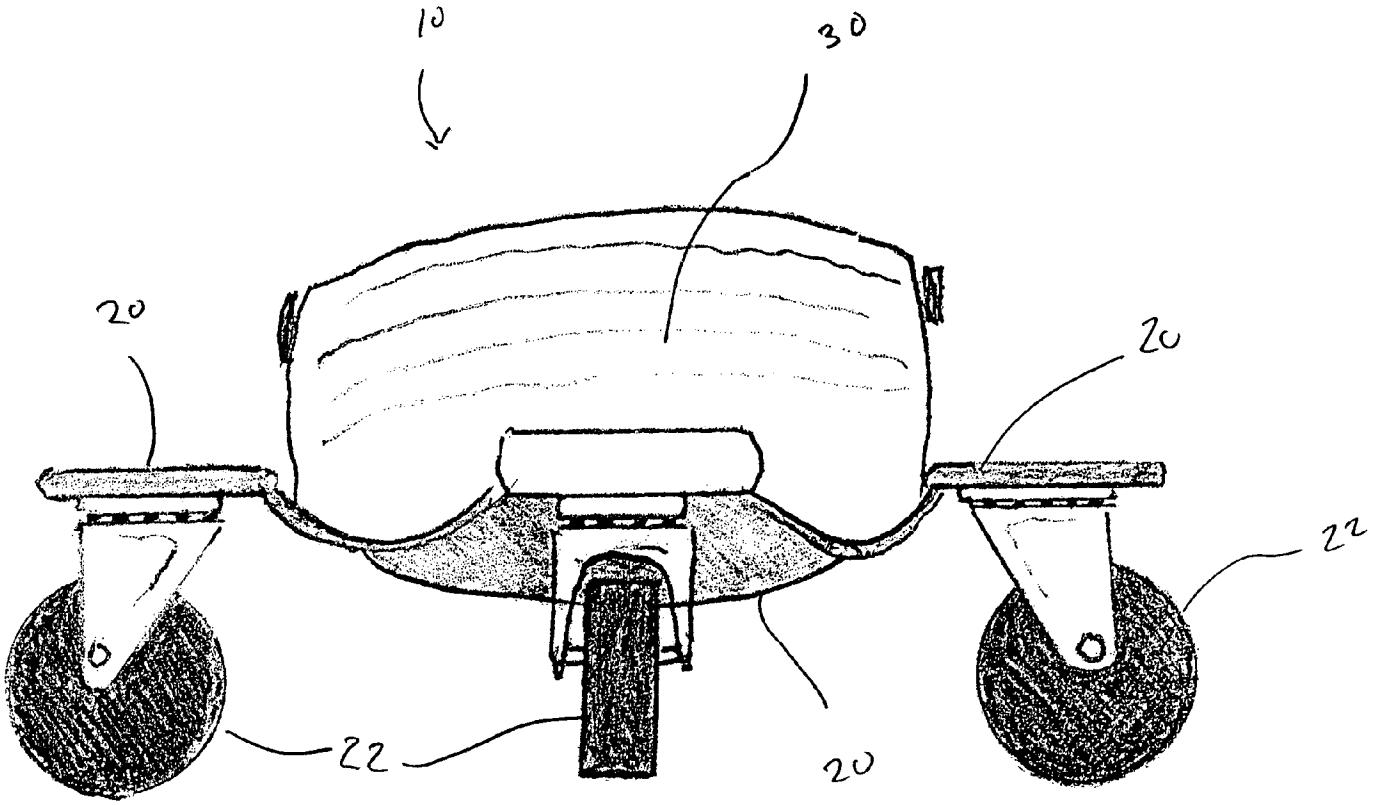
FIG. 7 is a front, elevational view of the rolling kneepad device of FIG. 1.

Referring now to the FIGURES, a rolling kneepad device 10 comprises a multiple wheeled support assembly 20, best seen in FIGS. 3 and 7, equipped with a plurality of swivel casters 22. Support assembly 20 provides structure to the rolling kneepad device 10. A kneepad cushion 30 is provided on an upper surface of the multiple wheeled support assembly 20 to comfortably receive a user's knee 62. A shin guard 40 is adjacently attached to the multiple wheeled support assembly 20, and is supported thereby in a cantilevered fashion. Typically, shin guard 40 is hingedly attached to support assembly 20 to allow some movement in the vertical direction. A hinge 46 is shown schematically in FIG. 3. Shin guard 40 may optionally have cushioning, not shown, disposed along all or a part of the upper, concave surface thereof. Cushioning 42 is provided as needed to comfortably receive a user's shin and upper foot. A plurality of strap fasteners 50 is provided to secure the user's knees, shins, and/or ankles to the rolling kneepad 10. No strap fasteners 50 are required at a midpoint of the shin guard 40.

Figure 1:
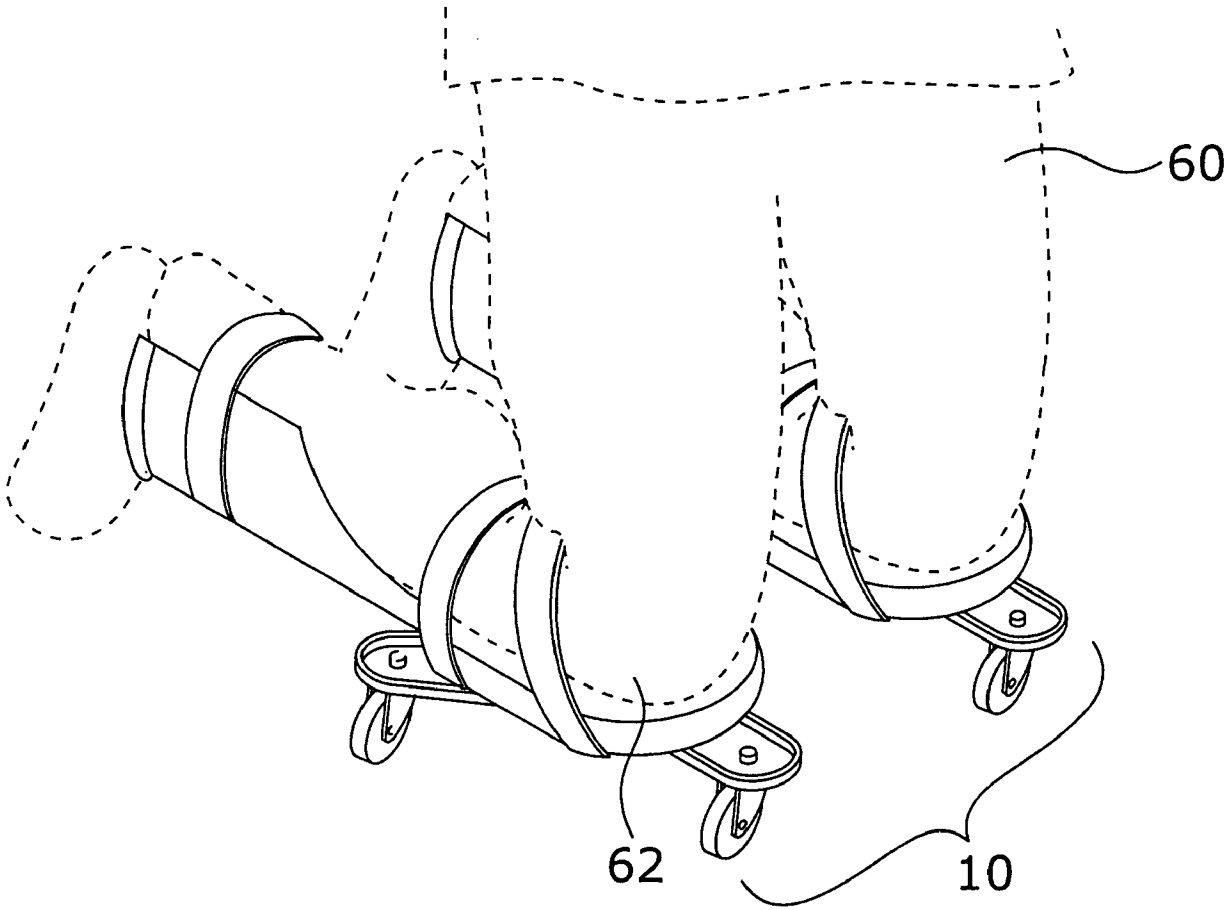
FIG. 1 is an environmental, perspective view of a rolling kneepad device with shin guard and supports according to the present invention with a user in a kneeling position.
Figure 2:
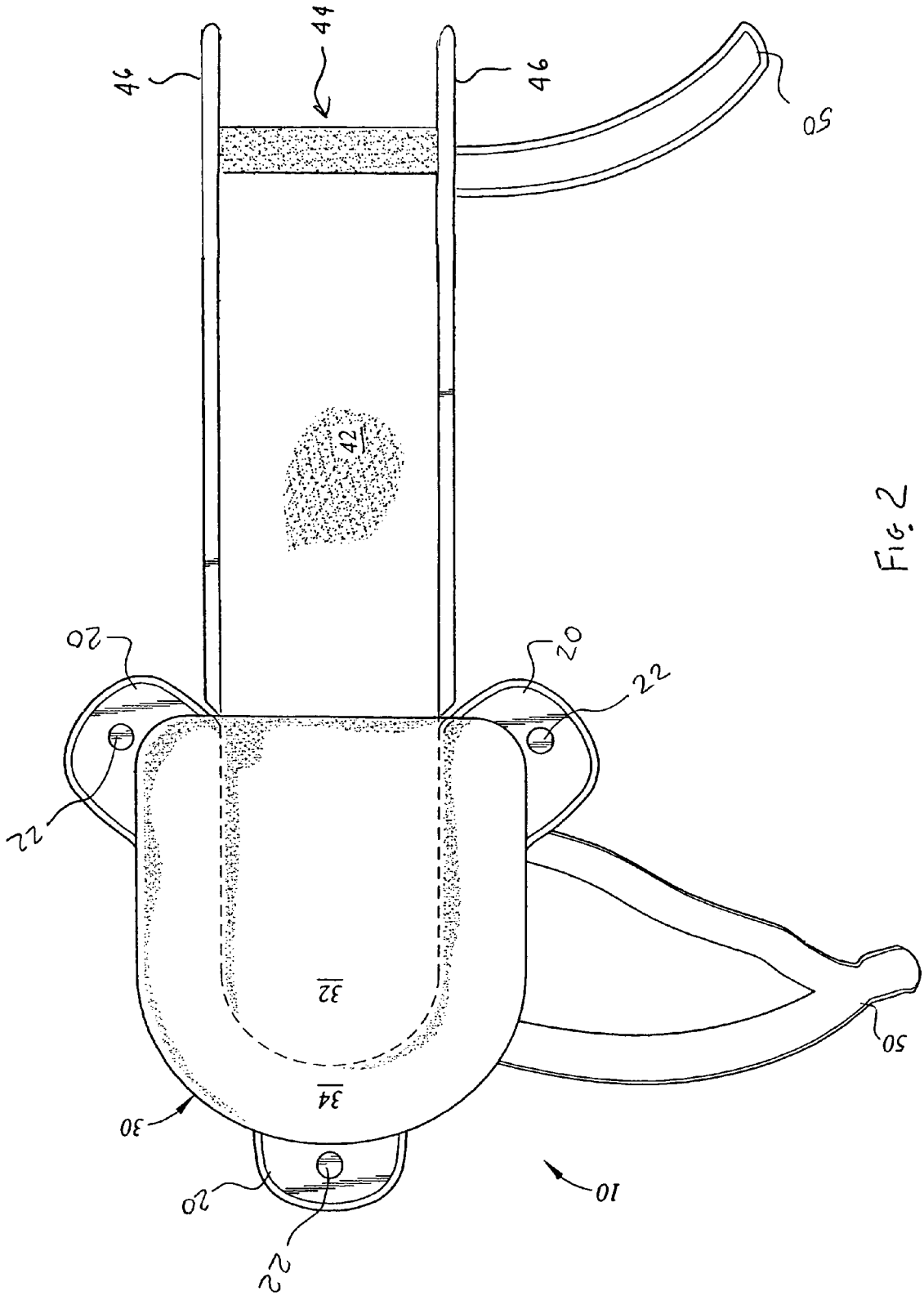
FIG. 2 is a top plan view of the rolling kneepad device of FIG. 1.

As is shown in FIG. 2, the multiple wheeled support 20 and the shin guard 40 are both provided with kneepad cushioning 30 and optional shin guard cushioning 42, respectively. The multiple wheeled support 20 has three swivel casters 22, which are typically equally spaced apart, independently movable and which can turn and roll in any direction desired by a user 60. The multiple wheeled support 20 allows users 60 to move in any direction by shifting their weight and pushing off against the ground with a distal portion of their feet and toes. It will be recognized that other numbers of casters 22 and/or placement thereof on wheeled support 20 may be provided to meet a particular operating circumstance or environment.

Figure 4:
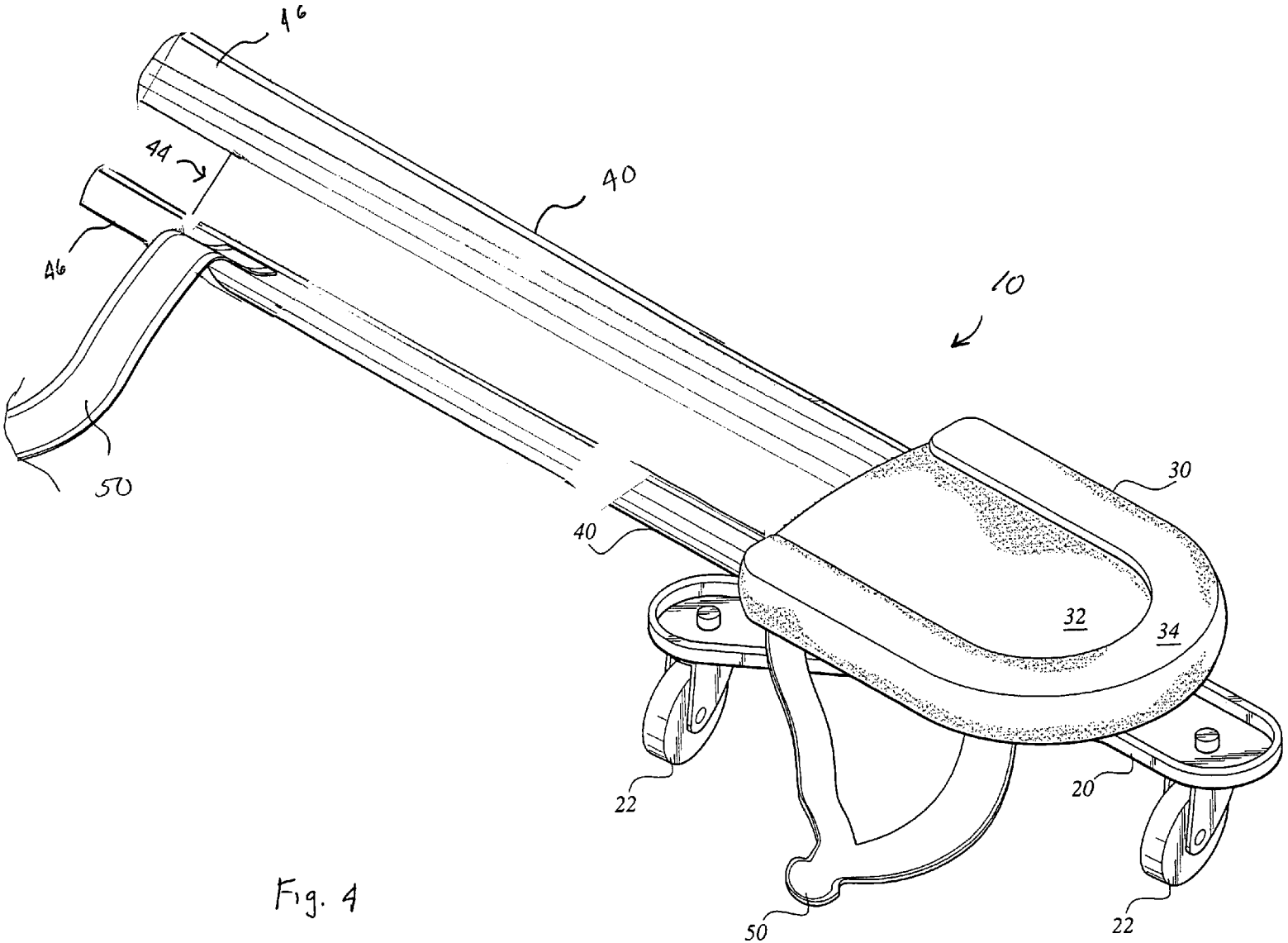
FIG. 4 is a topside perspective view of a rolling kneepad device of FIG. 1.
Figure 5:
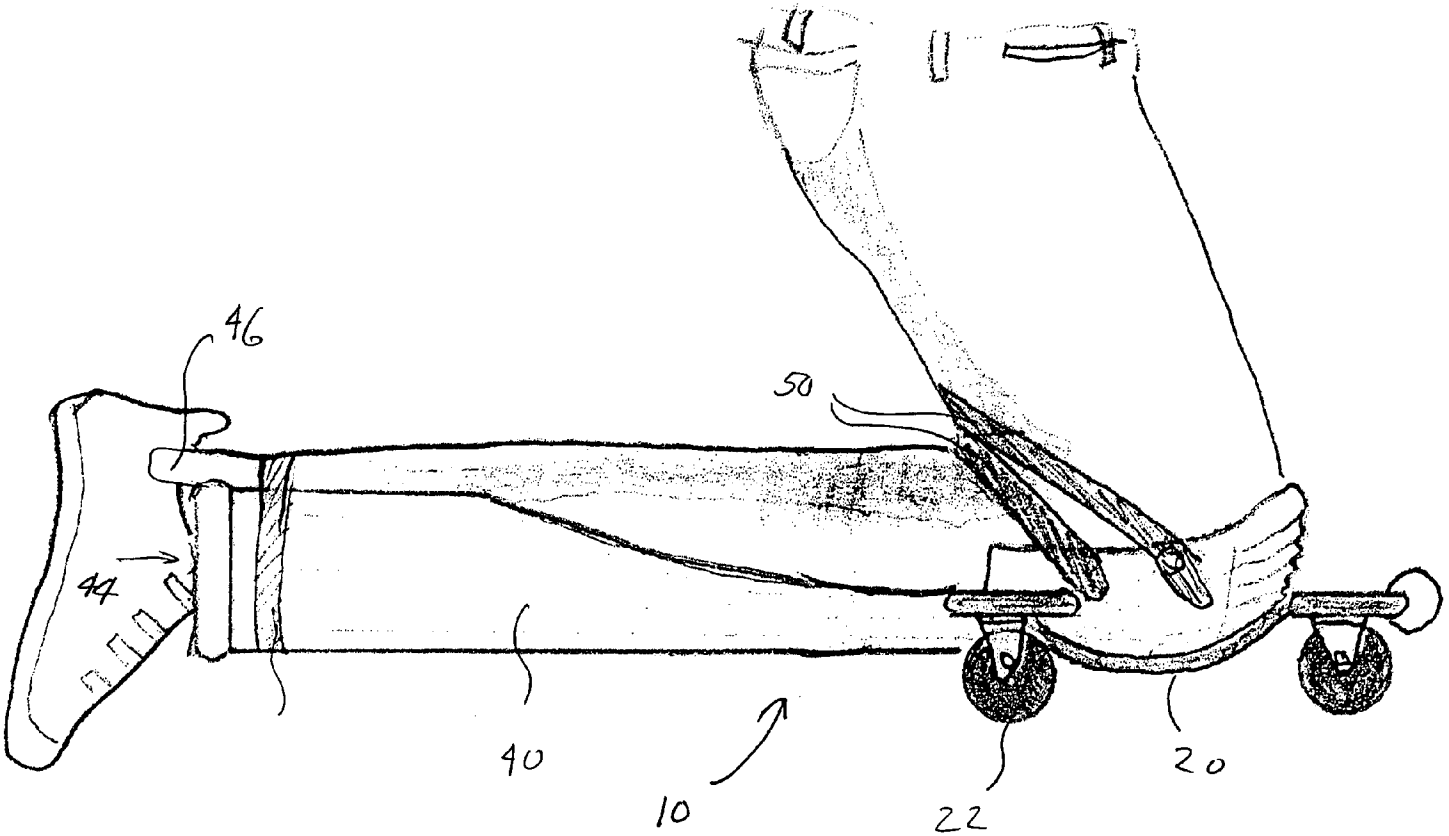
FIG. 5 is a side, elevational, environmental view of the rolling kneepad device of FIG. 1.
Figure 6:
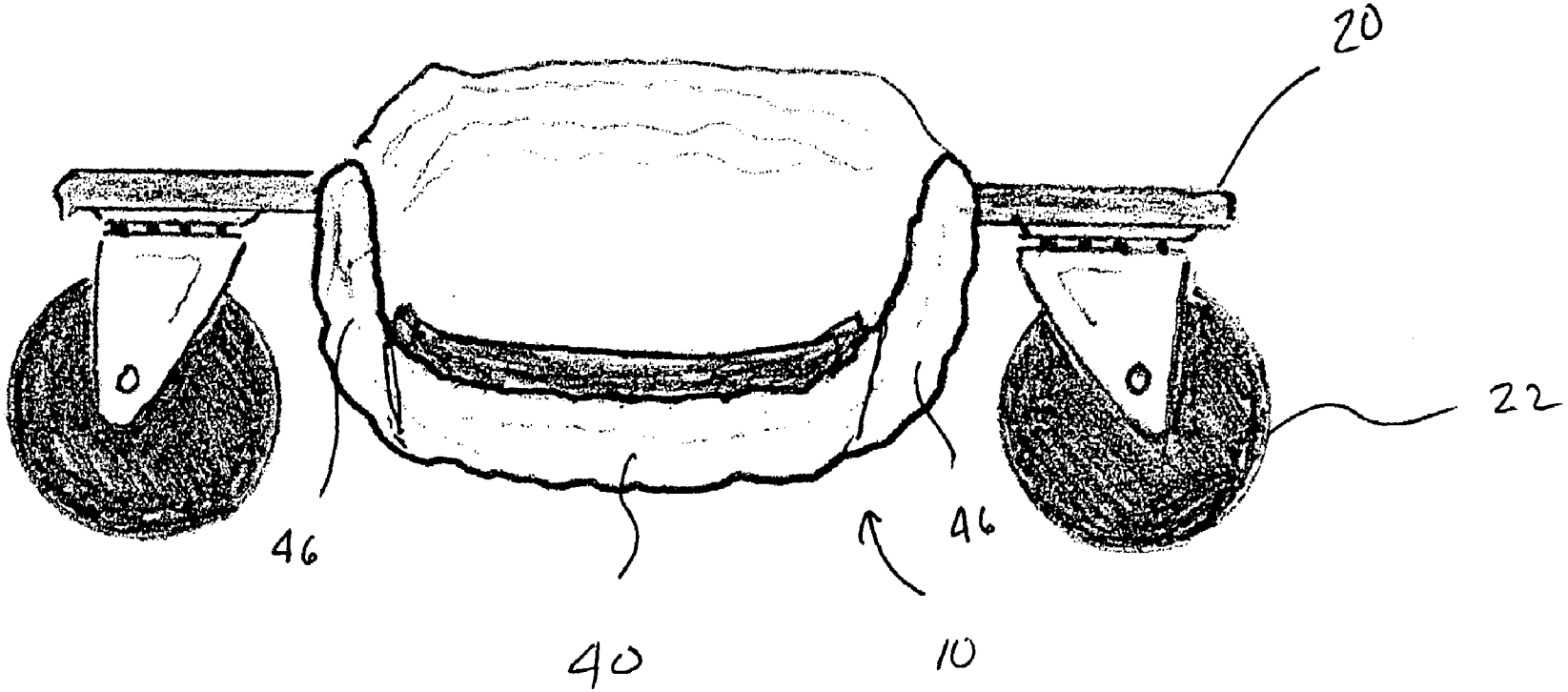
FIG. 6 is a rear, elevational view of the rolling kneepad device of FIG. 1.

As may be seen in FIGS. 2 AND 4, kneepad cushion 30 is ergonomically designed to receive a user's 60 knee, as depicted with a generally depressed middle portion 32 and raised perimeter portion 34. As may be seen in FIGS. 4 and 6, shin guard 40 is substantially concave, typically U-shaped so as to ergonomically receive a user's 60 shin and upper foot. The height of the multi-wheeled support 20 is sufficient to prevent shin guard 40 from scraping against the floor, ground or other surface. The distal end 44 of the shin guard 40 terminates in such a way as to allow the lower portion of a user's 60 foot to extend therebeyond to allow the user to push off of the ground to propel himself along the ground. The distal end 44 of the shin guard 40 serves as a cushion to comfortably handle the device's weight being transferred from the plurality of strap fasteners 50 when the user 60 stands up and the distal end 44 rests on the top of a user's shoe or boot. A pair of elongated members 46 extend beyond distal end 44 of shin guard 40 so as to fit upper side regions of a user's 60 shoes. Elongated member 46 help prevent rotation of rolling kneepad device 10, especially when user 60 moves from a kneeling to a standing position and walks with rolling kneepad device affixed to his or her body.

Several devices in the related art have substantially elongated shin guards provided as part of a rolling kneepad caster device. U.S. Pat. No. 2,448,427 issued to Gordon, U.S. Pat. No. 5,380,021 issued to Doherty and U.S. Pat. No. 5,427,391 issued to Cooper outline similar rolling kneepad caster devices that include shin guards. These rolling kneepads, however each have their shortcomings. The pair of individual knee and shin provisions are joined together and are not independently separate to allow for greater mobility with the devices outlined in the Gordon and the Doherty patents. The kneepads taught in U.S. Pat. No. 5,427,391 issued to Cooper also utilize shin guards, but do not enable a user to use the top of his or her feet to propel themselves on the ground.

Figure 8:
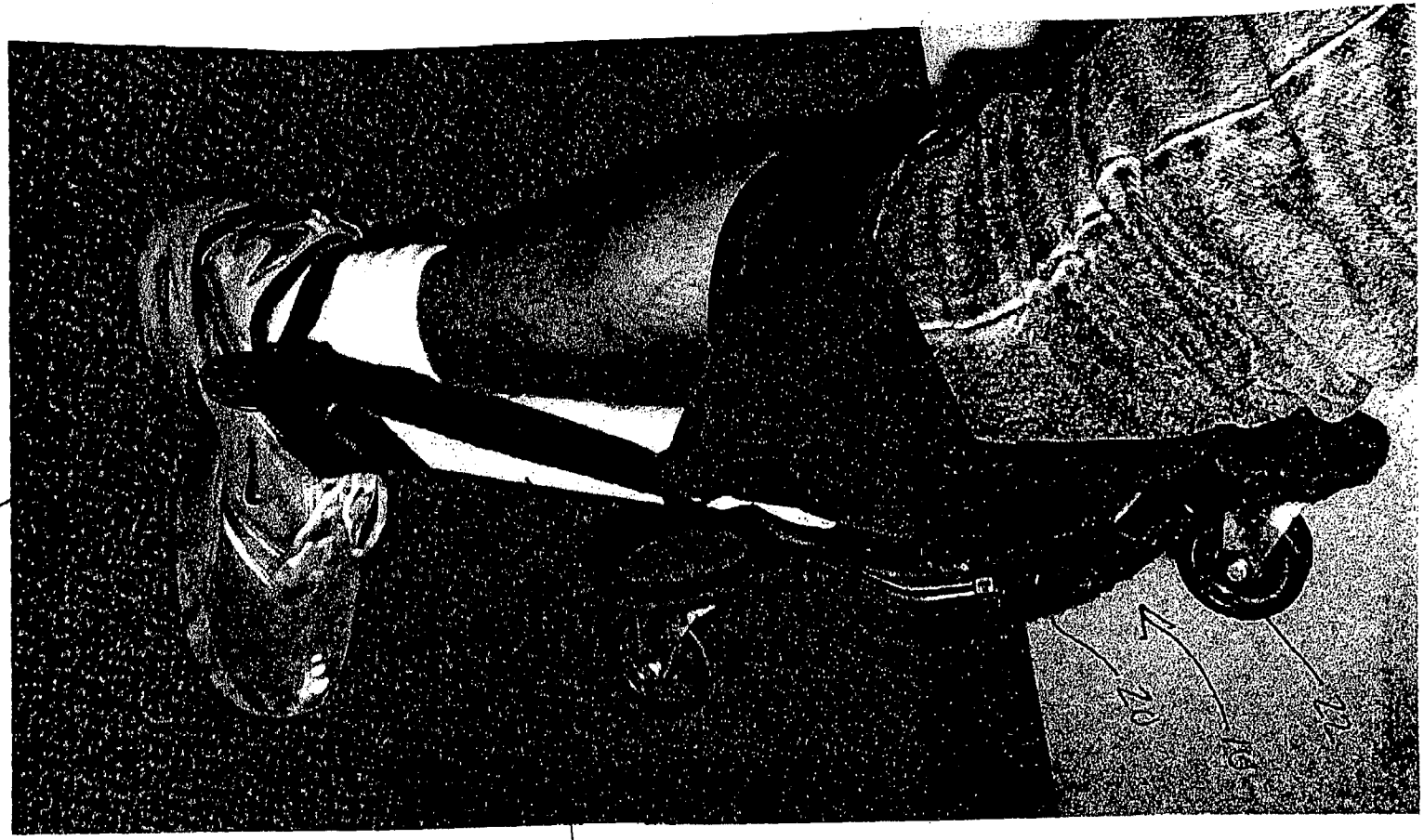
FIG. 8 is a side, perspective, environmental view of the rolling kneepad device of FIG. 1 with a user in a standing position.

The rolling kneepad device 10 provides greater comfort and greater maneuverability for a user 60 than do the devices outlined in these other patents. Also, because of the configuration of the kneepads/shin guards of the present invention, users may easily stand and walk, and kneel again without manually readjusting the rolling kneepad devices 10. This is because the distal end 44 of the shin guard 40 rests atop a user's foot when the user is standing, thereby preventing downward slippage of the knee pad/shin guard 30, 40 as happens with similar devices of the prior art. In addition, elongated extensions 46 help prevent rotation of shin guard 40 by resting against the upper sides of a user's 60 show or boot as may bee seen in FIG. 8.

FIG. 4 also depicts the rolling kneepad 10. Optionally, shin guard 40 may be cushioned with a padding material 42.

A plurality of fastening straps 50 is provided to be placed over the multiple-wheeled support 20 as well as the shin guard 40. The plurality of strap fasteners 50 are secured, typically using a snap connector, not shown, hook and loop fasteners, not shown that are both well known to those of skill in the art. It will be recognized that many different types of fasteners may be used to secure the ends of straps 50. The plurality of strap fasteners 50 is typically made of nylon or a similar material and have hook and loop fasteners or other suitable fasteners provided at their ends. If hook and loop fasteners are not used, alternate fasteners which allow adjustable tightening of straps 50 around the user's knee, leg, or ankle may be provided.

Use of the rolling kneepad device 10 is uncomplicated. A typical user 60 attaches the rolling kneepad 10 manually to each of his or her knees and lower shins, allowing for the top of their feet to push against the ground thereby propelling themselves. The plurality of strap fasteners 50 is self-adjusting so that one size fits all. It will be recognized that the number of straps 50, the location of straps 50 on wheeled support 20 and shin guard 40, the material used to manufacture straps 50, and the fasteners used to secure the inventive rolling kneepad 10 to a user thereof may vary. Consequently, the invention is not considered limited to the materials, configurations, and fasteners chosen for purposes of disclosure.

As previously noted, the swivel casters 22 attached to the multiple-wheeled support 20 move independently from each other and can maneuver and roll in any direction. Users 60 can also easily manually remove the rolling kneepad device 10 from their knees and shins.

As previously stated, the rolling kneepad of the invention is designed with a one size fits all philosophy. However, in alternate embodiments, shin guard 40 may be removably attached to support 20. This allows shin guard 40 to be provided in different lengths to comfortably accommodate either very short or very tall persons. In still other alternate embodiments, shin guard 40 may be made such that its length is adjustable, also to accommodate very short or very tall persons. An adjustable length shin guard 40 allows an individual user to optimize the fit of the rolling kneepad of the invention to their physique and/or preferences.

In addition, in still other alternate embodiments of the rolling kneepad, support 20 may have a quick disconnect feature allowing shin guard 40 and knee padding 40 to remain attached to the wearer's body without the weight and bulk of support 20.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A rolling kneepad, comprising:

a) a knee support platform adapted and configured to receive the knee of a user at an upper region thereof;

b) a shin guard peripherally affixed to said knee support platform and extending outwardly therefrom, said shin guard having a distal end and being configured such that said distal end is positioned adjacent an upper region of a shoe of said user, said shin guard comprising a pair of elongated extensions on respective side portions thereof, said elongated extensions extending beyond said distal end;

c) means for securing at least one of said knee support platform and said shin guard to at least one of a knee, a shin, a leg, and an ankle of said user;

d) means for rolling disposed solely on a lower surface of said knee support platform;

wherein, when said user of said rolling kneepad moves from a kneeling to an upright position, said distal end of said shin guard supports said rolling kneepad against said upper region of said shoe of said user, thereby preventing movement of said rolling kneepad downward along a leg of said user.

2. The rolling kneepad as recited in claim 1, wherein said means for rolling comprises a swivel caster.

3. The rolling kneepad as recited in claim 2, wherein said swivel caster comprises a plurality of swivel casters.

4. The rolling kneepad as recited in claim 3, wherein said plurality of swivel casters comprises three swivel casters.

5. The rolling kneepad as recited in claim 3, wherein said plurality of swivel casters move independently from one another.

6. The rolling kneepad as recited in claim 3, wherein each of said plurality of swivel casters is substantially equally spaced apart from one another and each of said plurality of swivel casters can turn and roll in any direction.

7. The rolling kneepad as recited in claim 1, wherein said shin guard further comprises padding selectively disposed along an upper portion thereof.

8. The rolling kneepad as recited in claim 1, wherein said support platform further comprises padding disposed along at least a portion of said upper portion.

9. The rolling kneepad as recited in claim 8, wherein said padding comprises a kneepad cushion.

10. The rolling kneepad as recited in claim 9, wherein said kneepad cushion comprises a recessed inner region adapted to receive said knee of said user.

11. The rolling kneepad as recited in claim 8, wherein said padding comprises at least one of a soft foam rubber material, and a gelatinous material.

12. The rolling kneepad as recited in claim 1, wherein said means for securing comprises an elongated strap.

13. The rolling kneepad as recited in claim 12, wherein said elongated strap comprises at least two elongated straps.

14. The rolling kneepad as recited in claim 12, wherein said elongated strap comprises a Nylon elongated strap.

15. The rolling kneepad as recited in claim 12, wherein said elongated strap further comprises means for fastening disposed proximate a distal end thereof.

16. The rolling kneepad as recited in claim 15, wherein said means for fastening comprises a hook and loop fastener.

17. The rolling kneepad as recited in claim 1, wherein said pair of elongated extensions are adapted and configured to extend along an upper portion of a side region of a shoe of said user whereby rotation of said rolling kneepad is limited when said user is in a standing position.

18. The rolling kneepad as recited in claim 1, wherein said shin guard comprises at least one of the configurations: said shin guard has an adjustable length, and said shin guard is removably affixed to said support platform.

* * * * *